US005344071A

United States Patent [19]

Peifer

[11] Patent Number: 5,344,071

[45] Date of Patent: Sep. 6, 1994

[54] EXPANSION TANK AIRATION DEVICE

[76] Inventor: Frederick Peifer, 368 Bennett Rd., Springfield, Pa. 19064

[21] Appl. No.: 981,555

[22] Filed: Nov. 25, 1992

[51] Int. Cl.[5] ..... F24D 3/10

[52] U.S. Cl. ..... 237/81; 237/66; 137/206

[58] Field of Search ..... 237/66, 59, 63, 8 R, 237/56, 81; 137/203, 206

[56] References Cited

U.S. PATENT DOCUMENTS 3,269,654 8/1966 Wood ..... 237/81

*Primary Examiner*—Henry A. Bennet

*Attorney, Agent, or Firm*—Paul & Paul

[57] ABSTRACT

A method for purging water from flooded expansion tanks without necessitating the complete drainage and subsequent refilling of the systems allows for a stabilized hydronic water system in much less time with less effort and expense.

8 Claims, 2 Drawing Sheets

EXPANSION TANK AIRATION DEVICE

BACKGROUND OF THE INVENTION

The hydronic heating system used to heat homes and other dwellings has been in existence for many years and despite the development of many other hot air systems still remains a reliable and efficient means of heating. Generally in these systems, water is heated in a boiler and is pumped or forced under pressure throughout a myriad of pipes interconnected between each room in the building. As the hot water collects in one or more of the basins or radiators attached thereto, the metal pipes get hot and warm the surrounding air.

It is very important in these systems to keep the pipes full of water at all times. However, due to the expansion and contractions of water as it is heated and cooled, provisions must be made in the system to accomodate this. As the system temperature changes, the water in the system expands and contracts at a different rate than the metal that contains it.

As a result of the need to provide space or room for expansion, a necessary development was the expansion tank which is an accessory reservoir attached to the boiler. U.S. Pat. Nos. 4,414,464 to Cloutier and 3,627,203 to Martin are both indicative of the known state of the expansion tank art and their use in hydronic heating systems. These patents are hereby incorporated by reference. Generally, the tank is half filled with water with the remaining space occupied by air. This air space provides room for expansion/contraction of the water. The problem that arises however, is that water absorbs air slowly over time and as the air volume is reduced there is a corresponding reduction in the pressure that is produced thereby and is responsible for keeping additional water out. As more water enters the tank it eventually reduces the air cushion in the expansion tank to a point where no provision for water expansion is left. Furthermore, the water in the expansion tank is constantly circulating between the tank and the boiler and as it does, it carries the tank air out into the rest of the system. The air that gets into the system results in the often unsettling knocking and gurgling noises in the pipes with which everyone is familiar.

Another problem that arises by the removal and absorption of air by water is that the expansion tank eventually becomes completely filled with water and flooded and as a result no leeway exists for expansion. In the past, in order to alleviate the problem, air has to be pumped back into the tank. Numerous devices have been developed for collecting expansion tank air which is then pumped back into the expansion tank. Some devices collect the air as it is released in the boiler others collect it at some point in the system's pipes and pump it back to the tank. These are marginally effective however, and require the use of air vents on all the radiators, pipes and the boiler. Other manual means of pumping air back into the system requires drainage of the system, pumping air back into it and refilling the boiler and pipes which is both time consuming and costly. This unfortunately, is what is most often required.

The present invention is a means to put air back into the expansion tank without having to drain the entire system and later refill it. Other attempts to do this have been made in the past but nowhere are the results achieved in such a simple and efficient manner.

U.S. Pat. No. 4,013,221 to Eder entitled Pressure Balancing Device for Heating Systems discloses an expansion tank with a number of internal chambers which are connected to a heating system by feed and drain pipes whereby the flow of water into and out of the expansion tank is regulated by a valve and a pump. The pressure sensitive device actuates the pump to force water from the expansion tank to the heating system when there is a drop in pressure in the system. The device also detects when there is too much pressure in the system and opens the solenoid valve so that water can escape back into the expansion tank. The device works by means of a bellow within the expansion tank which is in contact with the outer air. The invention is directed to the regulator device which monitors pressure and water problems rather than solves them. There is no appreciation of the problems resulting from flooded expansion tanks nor is there any suggestion of any means to cure the problem.

U.S. Pat. No. 4,424,024 to Wilson, et. al. discloses a conventional heating system whereby an expansion tank is in operative communication with a furnace or hot water storage unit so that any back up of water or expansion thereof from the boiler unit is released to the expansion tank wherein it is contained. Any subsequent drop in pressure in the heating system results in a release of the water back to the boiler unit.

U.S. Pat. Nos. 4,301,320 to Hochstrasser, et. al. and 4,417,871 to Tarumi, et. al. also disclose conventional expansion tanks with release and/or drain valves as a part of heating systems known in the art. As before, neither of these patents appreciate the problems inherent in expansion tank flooding and the alleviation thereof. Valves and drain cocks are disclosed which presumably are used to drain the entire system as is known in the art.

SUMMARY OF THE INVENTION

Figure 1:
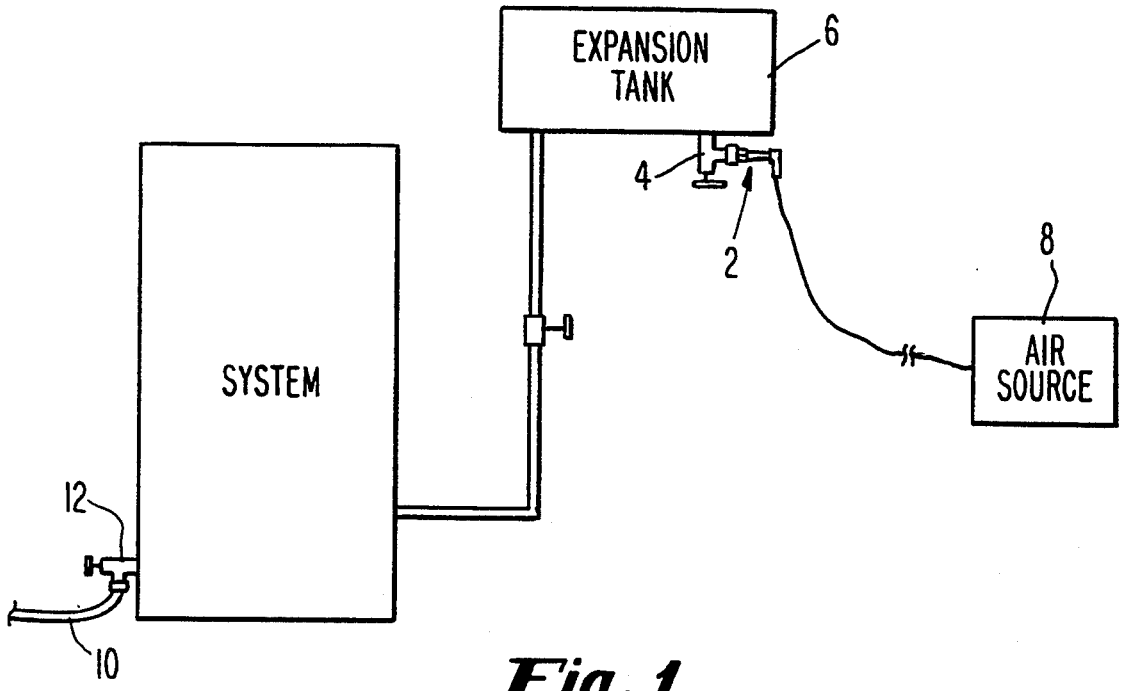
FIG. 1 is an overall schematic view of a boiler unit and attached expansion tank together with the flusher component of the present invention attaching the air pump directly to the expansion tank drain valve.

The present invention is a simple and effective means to partially clear flooded expansion tanks used in conventional hydronic heating systems. An air pump means is attached to the drain valve of the expansion tank by a specially modified flusher connection component. Air is then pumped into the tank, forcing the water contained therein out into the system. Knowing the dimensions of the expansion tank, the amount of water needed to be removed is calculated and the water then can be drained from the boiler without the need for purging and refilling the entire system.

DETAILED DESCRIPTION OF THE INVENTION

In order to properly flush a flooded expansion tank using the device of the present invention, it is necessary to know the proper water/air ratio that exists for the tank in question. It is therefore necessary to determine the volume of the expansion tank. Once this volume is known, approximately one-half that volume of water can be removed and the proper water/air ratio will be achieved.

Since the average residential expansion tank is designed to fit between floor joists that allow fourteen inches (14") between joists (16"center to center), conventional residential expansion tanks are generally twelve inches (12") in diameter, the radius being six inches (6"). This measurement is a constant. The length of the tank varies depending upon the size of the system and its requirements.

The volume of the expansion tank can be determined by using the formula for determining the volume of a cylinder ($V = \Pi r^2$) and multiplying that by the length of the tank.

| | |
|---|---|
| Example: | $(V = \Pi r^2) \times \text{length}$ |
| | $V = (3.14 \times 6^2) \times \text{length}$ |
| | $V = (113.04^2) \times \text{length}$ |
| IF: length = 30" | |
| Then: | $V = 3391.2 \text{ in.}^3$ |

Knowing that the volume of one gallon of water is 231 $in^3$, and given the above information, by dividing the cubic inches of the tank by 231 cubic inches, one can determine how many gallons of water are contained in the expansion tank. By knowing how many gallons the expansion tank holds, how much water should removed from a given system can be determined in order to achieve a proper air/water ratio. Generally, one-half of the volume of a filled expansion tank will be drained in order to create the proper water/air equilibrum. By using the constant $r = 113.03$ $in.^2$ and multiplying that constant by the length of the expansion tank, the following chart can enable one to determine how much water to remove from a given tank. The diameter constant is that for conventional residential expansion tanks.

| Diameter Constant $\Pi^2$ | Tank Length in. | Capacity Volume $in.^3$ | Capacity Gals. | Gallons to Remove ½ of Vol |
|---|---|---|---|---|
| 113.04 | 22" | 2486.8" | 10.76 | 5.38 |
| 113.04 | 24" | 2712.9" | 11.74 | 5.87 |
| 113.04 | 26" | 2939.0" | 12.72 | 6.36 |
| 113.04 | 28" | 3165.1" | 13.70 | 6.85 |
| 113.04 | 30" | 3391.2" | 14.68 | 7.34 |
| 113.04 | 32" | 3617.2" | 15.65 | 7.82 |
| 113.04 | 34" | 3843.3" | 16.63 | 8.31 |
| 113.04 | 36" | 4069.4" | 17.16 | 8.58 |
| 113.04 | 38" | 4295.5" | 18.59 | 9.29 |
| 113.04 | 40" | 4521.6" | 19.57 | 9.78 |
| 113.04 | 42" | 4747.6" | 20.55 | 10.27 |
| 113.04 | 44" | 4973.7" | 21.53 | 10.75 |
| 113.04 | 46" | 5199.8" | 22.50 | 11.25 |
| 113.04 | 48" | 5425.9" | 23.48 | 11.74 |

Figure 4:
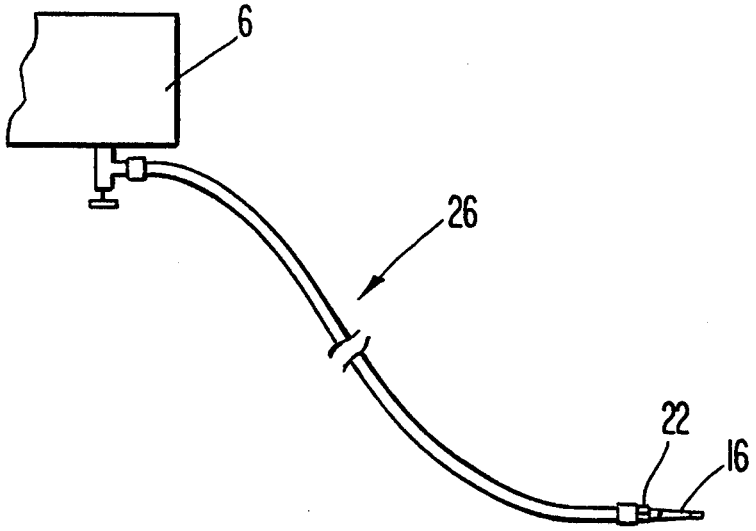
FIG. 4 is a second embodiment of present invention wherein the flusher component and air pump are attached to a hose.

As shown in FIG. 1, in order to remove the water from the flooded expansion tank, the flusher element (2) of the present invention is attached directly to the drain valve (4) of the expansion tank (6). Preferably the air pump (8) is attached directly to the flusher element (2) and operated accordingly. In a second embodiments a hose or tube (26) may also be used to attach the air pump (8) to the drain valve (4) of the expansion tank (6), as shown in FIG. 4. The flusher element (2) is then attached at the distal end from the valve. The hose is generally utilized in this manner in instances where the pumping mechanism must be located some distance from the valve due to space limitations.

A second hose (10) is then attached to the boiler drain valve (12) at one end and fed to a graduated bucket at the other end (not shown) so that the amount of water drained from the system can be monitored. The pressure that is inherently built up in the system must first be released at the drain valve (12) attached to the boiler. Referring again to FIG. 1, the flusher component (2) of the present invention is attached to the expansion tank drain at this time and acts as a connective piece for the pump which provides the pressure to expel the excess water and residual pressure. Again, a hose as shown in FIG. 4 can also optionally be connected therebetween if necessary.

Figure 2:
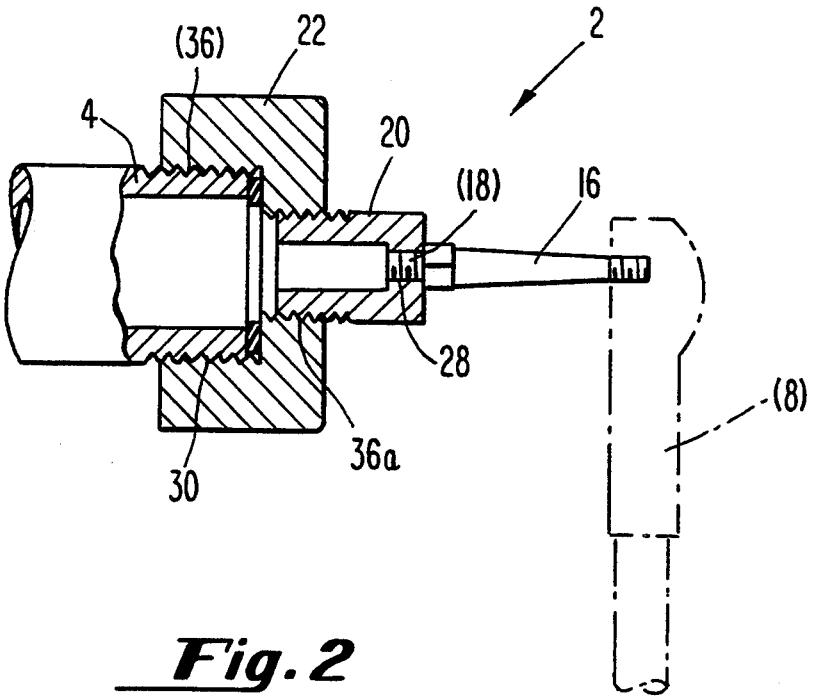
FIG. 2 is a cross-sectional view of the flusher component useful in the practice of the present invention.

Referring now to FIG. 2, the flusher connector element is comprised of a standard Schrader Air Valve (16) which is threadably attached (18) to a one-half (½) or three-quarter (¾) inch by one-eighth (⅛) inch bushing (20). A duel female adapter (22) threadly engages both the male end of the bushing (36*a*) and the male threads of the expansion tank drain valve (4), thereby attaching the air valve (16) to the drain valve (4). The air pump (8) attaches directly to the air valve (16) and is operated accordingly.

Figure 3:
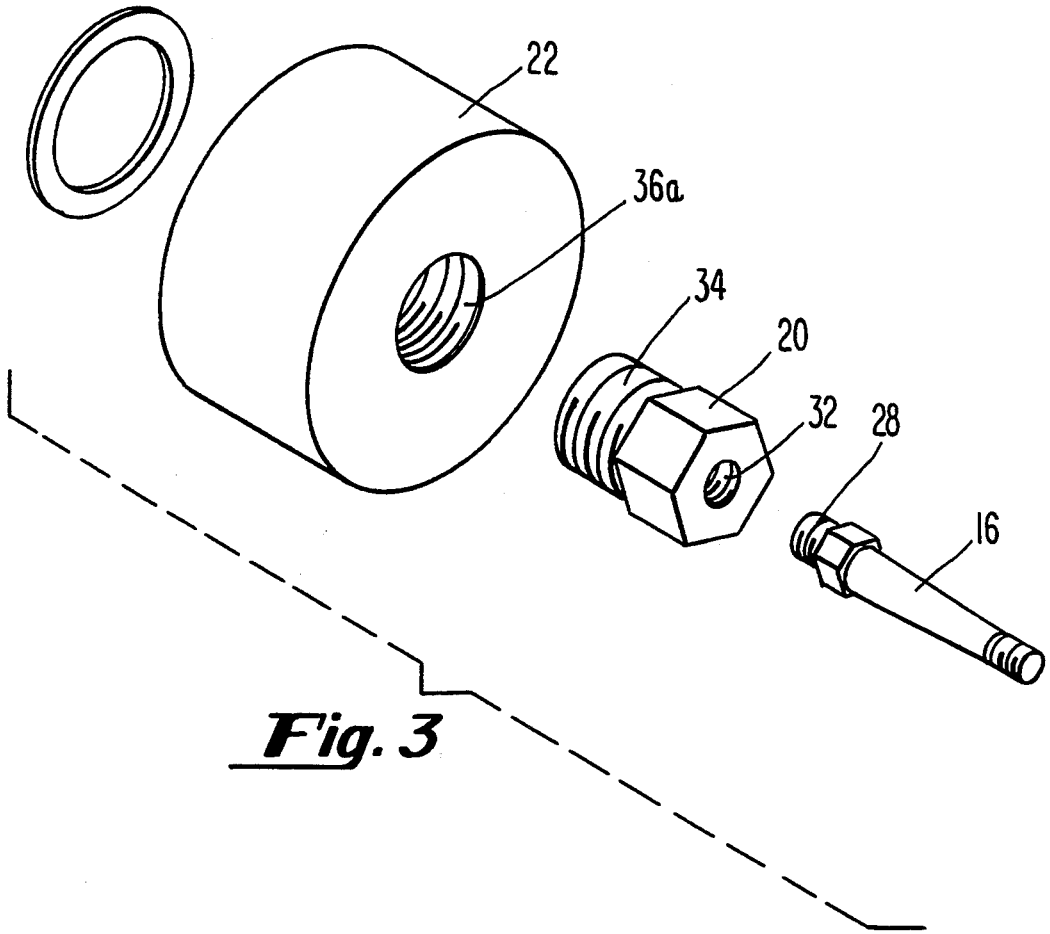
FIG. 3 is an exploded schematic diagram of the flusher component useful in the practice of the present invention.

Referring now also to FIG. 3, the flusher connector (2) then, is a means for connecting the male threading (28) of an air valve (16) that is smaller and incompatible with the male threading (30) on the expansion air tank drain valve (4). This is made possible using the bushing (20) which contains both male (32) and female (34) threaded ends. The duel female adapter (22) possessing two different sized female threaded ends (36*a*,36*b*) enables the attachment of the smaller sized bushing (20) and air valve (16) to the larger expansion tank valve (4).

FIG. 4 is a further embodiment of the present invention for use when the boiler and expansion tank is in an area in which tight space prohibits attachment of the air pump directly to the Schrader Air Valve. A hose or tubing (26) may be attached to the drain valves and the pump so that the actual air source can be operated some distance from the valve.

Air is pumped into the system, i.e. the expansion tank (6), and the drain valve of the boiler unit (12) is opened and pressure is released. As additional air is pumped into the system, water is forced out and the pumping continues until the desired amount of water is flushed out of the expansion tank and subsequently the boiler unit. The right amount is known by monitoring the amount of water collected in the calibrated bucket. Once the amount of water equivalent to one-half the volume of the expansion tank is collected, the valves are closed and the system stabilized and equilibrated by continued pump of air into the system until the desired system pressure is reached. This is determined by reading the boiler pressure/altitude gauge. Usually a reading of 10–12 psi is suitable.

Whereas minor variations and modifications are always possible which can change the present invention by varying degrees, they are all contemplated as falling within the spirit and scope of the following claims.

What I claim is:

1. A method for the purging of water from a flooded expansion tank in a hydronic heating system comprising:

a) calculating the volume of water equivalent to one-half the volume of the expansion tank;

b) pumping air into the drain valve of the expansion tank;

c) opening the drain valve of the associated boiler unit;

d) draining an amount of water forced out by the air in an amount approximately equivalent to one-half the volume of said expansion tank and;

e) closing the valves.

2. The method of claim 1 wherein said air pump is connected directly to the drain valve of said expansion tank using a flusher connector component comprising an air valve threadably attached to a dual female adapter by means of a bushing.

3. The method of claim 2 wherein said water is forced from the expansion tank into the associated boiler unit.

4. The method of claim 3 wherein said boiler drain valve is closed prior to the cessation of pumping air in order to equilibrate the system.

5. The method of claim 4 further comprising a hose connected to the flusher component at one end and the expansion tank drain at the other.

6. The method of claim 2 wherein said air valve is a Schrader air valve.

7. A means for purging water from a flooded expansion tank consisting of an air source and a flusher component comprising an air valve, a bushing, and a dual female connector for attaching the air source to the drain valve of an expansion tank in an hydronic heating system.

8. A means for purging water from a flooded expansion tank consisting of an air source and a flusher component comprising a Schrader air valve, a bushing, a dual female connector and a flexible hose for attaching the air source to the drain valve of an expansion tank in an hydronic heating system.

* * * * *